United States Patent [19]

Wysocki

[11] Patent Number: 4,570,844

[45] Date of Patent: Feb. 18, 1986

[54] PAPERBOARD FRAME WITH LOCKABLE CORNERS

[75] Inventor: Lawrence S. Wysocki, Chicago, Ill.

[73] Assignee: Champion International Corporation, Stamford, Conn.

[21] Appl. No.: 658,404

[22] Filed: Oct. 5, 1984

[51] Int. Cl.[4] ..... B65D 5/00; B65D 5/26

[52] U.S. Cl. ..... 229/16 D; 229/35; 229/41 B

[58] Field of Search ..... 229/35, 16 D, 16 A, 229/16 R, 41 R, 41 B

[56] References Cited

U.S. PATENT DOCUMENTS

| | | | |
|---|---|---|---|
| 2,957,617 | 10/1960 | Bolding | 229/41 B |
| 2,980,316 | 4/1961 | Buttery et al. | 229/41 B |
| 3,003,676 | 10/1961 | De Nola | 229/35 |
| 3,603,500 | 9/1971 | Dutcher | 229/41 B |
| 4,305,544 | 12/1981 | Noonan | 229/35 |
| 4,349,147 | 9/1982 | Jensen | 229/35 |

*Primary Examiner*—Joseph Man-Fu Moy

*Attorney, Agent, or Firm*—Evelyn M. Sommer; William W. Jones

[57] ABSTRACT

A frame is made from a one-piece paperboard blank which is folded and glued into a collapsed shipment and storage configuration. The collapsed frame can be manually expanded for use. The corners of the expanded frame are locked by overlapping tabs to hold the frame in its expanded state. The frame can be used to hold air filters which are used to filter the air entering a hot air furnace.

4 Claims, 10 Drawing Figures

PAPERBOARD FRAME WITH LOCKABLE CORNERS

This invention relates to a frame which is made from a one-piece paperboard blank and which is folded and glued to a collapsed shipping and storage configuration. The frame is manually expandable to an expanded condition, and there are provided locking tabs for locking the corners of the expanded frame to prevent collapse thereof. The frame can be used to hold filters of the type designed for filtering the air entering a hot air furnace.

Hot air furnace filters which have paperboard frames are known in the prior art. Such frames are made from one-piece blanks which are folded and glued into a collapsed condition for shipping or storage. The frames are expanded manually to an expanded condition which is suitable for retention in the filterholding portion of the furnace. These prior art expandable frames rely on profiling of the ends of each side of the frame so that the tendency of the frame to reassume the collapsed condition will push the profiled ends of adjacent frame sides into interlocking engagement at each corner of the frame. With this type of bias interlock, when the expanded frames are handled, often one or more of the corners will accidentally unlock thereby causing the frame and filter to warp. When warped, the filter will not fit properly into the filter holder in the furnace. The unlocking of the corners happens when the expanded frame is squeezed during handling. When this happens, the user may be unaware of the unlocking of the corner or corners and may not understand why the frame and filter has become warped. Likewise, if a warped frame and filter is inserted into the furnace, the filter will not work properly.

This invention relates to an improved frame of the type suitable for use with a furnace filter which can be converted from a shipping and storage flat configuration to a use expanded configuration and which includes locking tabs formed at the corners of the frame which prevent accidental disengagement of the frame corners during handling. Thus the frame and filter will remain in the expanded state when the frame is handled in a normal manner. The locking tabs can be contoured for insertion into slots so that accidental withdrawal of the tabs from the slots is prevented, or the tabs can operate with an adhesive to bond the frame corners in the expanded state. When the adhesive is used, a peelable barrier is placed over the adhesive until the frame is expanded.

It is, therefore, an object of this invention to provide a paperboard frame member which can be manually converted from a flat shipping and storage configuration to an expanded use configuration.

It is an additional object of this invention to provide a frame of the character described having provisions to lock the corners of the frame when the latter is converted to the expanded configuration.

It is a further object of this invention to provide a frame of the character described which has locking tabs formed at its corners, which tabs are operable to secure the frame against accidental collapse from the expanded configuration.

These and other objects and advantages of this invention will become more readily apparent from the following detailed description of several preferred embodiments thereof when taken in conjunction with the accompanying drawings, in which.

Figure 1:
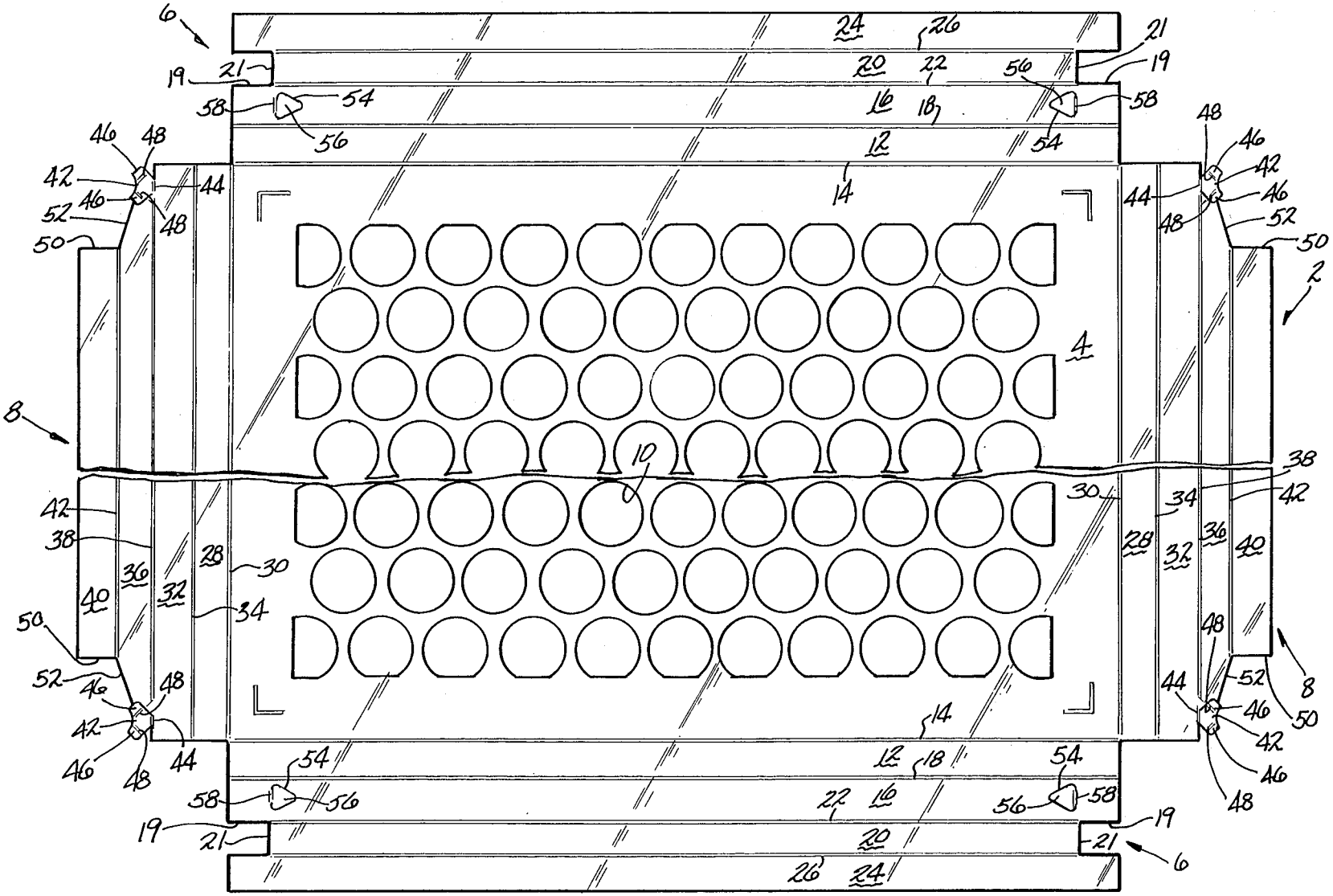
FIG. 1 is a plan view of a first embodiment of a cut and scored paperboard blank from which one form of a frame made in accordance with this invention can be made.

Referring now to FIG. 1, there is shown a first embodiment of a cut and scored paperboard blank denoted generally by the numeral 2. The blank 2 includes a back wall panel 4 and opposed sets of framing wall panels 6 and 8. It will be noted that the framing wall panels 6 are of similar construction and are parallel to each other and on opposite sides of the back wall panel 4. Likewise, the framing wall panels 8 are of similar construction and are parallel to each other on opposite sides of the back wall panel 4. The frame which is constructed from the blank 2 shown in FIG. 1 is designed for housing a furnace air filter. For this reason, the back wall panel 4 extends from one side of the blank 2 to the other. It will be understood that other uses for the frame may not require a full back wall 2 so that the latter could be a narrow bordering wall. In the furnace filter frame embodiment, the back wall 4 is provided with a plurality of holes 10 which allow passage of air through a filter element contained in the frame. Each of the framing panels 6 includes an outer side wall panel 12 connected to the back wall panel 4 along a fold line 14, a front wall panel 16 connected to the outer side wall panel 12 along a fold line 18, an inner side wall panel 20 connected to the front wall panel 16 along a fold line 22, and a glue panel 24 connected to the inner side wall panel 20 along a fold line 26. The edges 21 of the inner side wall panels 20 are recessed to form longitudinal edges 19 on the front wall panels 16 whose length is equal to the width of the front wall panels 16. Likewise, each of the framing panels 8 includes an outer side wall panel 28 connected to the back wall panel 4 along a fold line 30, a front wall panel 32 connected to the outer side wall panel 28 along a fold line 34, an inner side wall panel 36 connected to the front wall panel 32 along a fold line 38, and a glue panel 40 connected to the inner side wall panel 36 along a fold line 42. Locking tabs 42 are connected to end portions of each of the front wall panels 32 along fold lines 44 which are colinear with the fold lines 38. The locking tabs 42 include lateral ears 46 defined by fold lines 48. It will be noted that the side edges 50 of the glue panels 40 are inwardly offset from the locking tabs 42 and that the side edges 52 of the inner side wall panels 36 taper from the locking tabs 42 to the side edges 50 of the glue panels 40. A cut 54 forms a locking slot in end portions of each of the front wall panels 16. The locking slot is opened by deflection of the web 56 defined by the cut 54 and fold line 58. It will be noted that end edges 60 of the inner side wall panels 20 are inwardly spaced from the adjacent end edges of the panels 12, 16 and 24.

Figure 3:
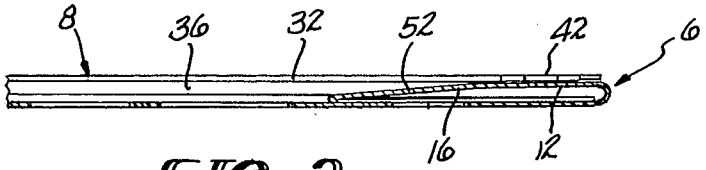
FIG. 3 is a sectional view of the flattened frame taken along line 3—3 of FIG. 2.
Figure 2:
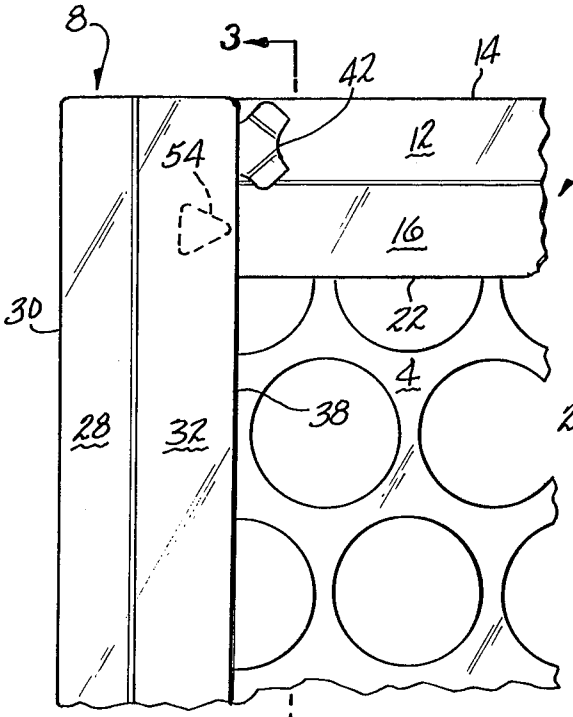
FIG. 2 is a plan view of the frame formed from the blank of FIG. 1 after the frame has been glued and converted to its flat shipping and storage form.

Referring now to FIG. 2, the frame is shown in its collapsed shipping and storage condition. This condition is achieved by folding the framing panels 6 about fold lines 14 and 22 toward the back wall panel 4 and gluing the glue panels 24 to the back wall panel 4. This places the outer side wall panel and the front wall panel 16 in relatively coplanar alignment. The framing panels 8 are then folded about fold lines 30 and 38 and the glue panels 40 are glued to the back wall panel 4. The outer side wall panel 28 and the front wall panel 32 are thus substantially coplanar and the framing panels 8 overlap the framing panels 6. The locking tabs 42 project beyond the fold lines 38 and overlie the outer side wall panels 12. FIG. 3 illustrates the manner in which the tapered edges 52 of the inner side wall panels 36 accommodate the overlapping of the framing panels 6 and 8.

Figure 4:
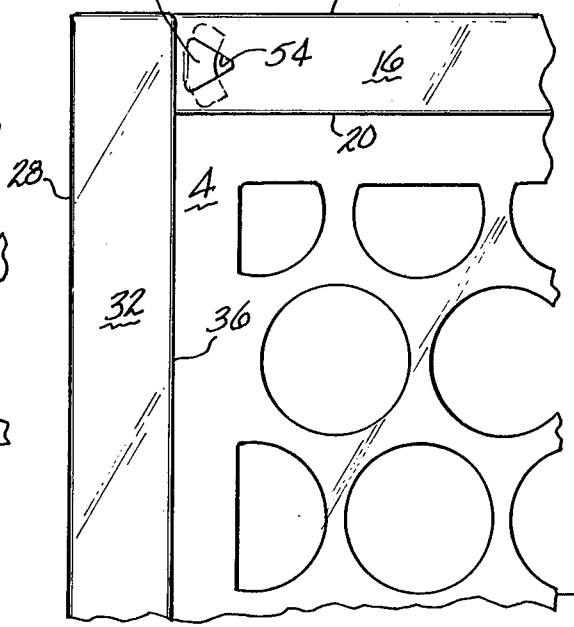
FIG. 4 is a plan view of the frame of FIG. 2 shown in the expanded form.

Referring to FIG. 4, the expanded condition of the frame is shown. To convert the frame from its flattened condition shown in FIG. 2 to its expanded condition shown in FIG. 4, one manually compresses the framing panels 6 and 8 by pressing the fold lines 14, 22 and 30, 38 toward each other. This causes the outer side wall panels 12, 28 and the inner side wall panels 20, 36 to pivot to positions which are perpendicular to the back wall panel 4. Concurrently, the front wall panels 16 and 32 are shifted away from the back wall panel 4 to a spaced position parallel to the back wall panel 4. This shifting of the front wall panels 16 and 32 uncovers the cuts 54 and exposes the latter for insertion of the locking tabs 42. The locking tabs 42 are then inserted into the locking slots formed by the cuts 54. The corners of the frame are thus locked so that the frame will not accidentally collapse when being handled.

Figure 5:
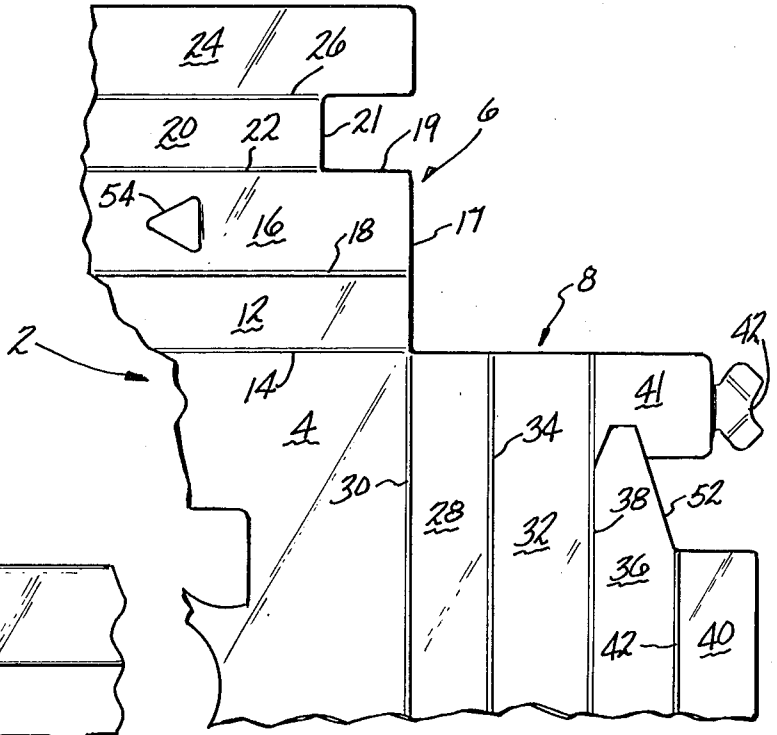
FIG. 5 is a fragmented plan view of one corner of a blank having a second embodiment of a corner lock formed in accordance with this invention.

FIG. 5 shows a second embodiment of the invention wherein the blank 2 has a back wall panel 4 and a pair of framing panels 6 and 8. The framing panels 6 include an outer side wall panel 12 connected to the back wall panel 4 along a fold line 14, a front wall panel 16 connected to the outer side wall panel 12 along a fold line 18, an inner side wall panel 20 connected to the front wall panel 16 along a fold line 22, and a glue panel 24 connected to the inner side wall panel 20 along a fold line 26. A cut 54 forms a locking slot in the front wall panel 16. It is noted that the locking slot is spaced considerably inwardly from the edge 17 of the front wall panel 16. The edge 21 of the inner side wall panel 20 is recessed to form a longitudinal edge 19 on the front wall panel 16 whose length is equal to the width of the front wall panel 16. The framing panel 8 includes an outer side wall panel 28 connected to the back wall panel 4 along a fold line 30, a front wall panel 32 connected to the outer side wall panel 28 along a fold line 34, an inner side wall panel 36 connected to the front wall panel 32 along a fold line 38, and a glue panel 40 connected to the inner side wall panel 36 along a fold line 42. The side edge 52 of the inner side wall panel 36 is tapered as previously described. The locking tab 42 is disposed on the end of an extension flap 41 which is connected to the front wall panel 32 by the fold line 38.

Figure 6:
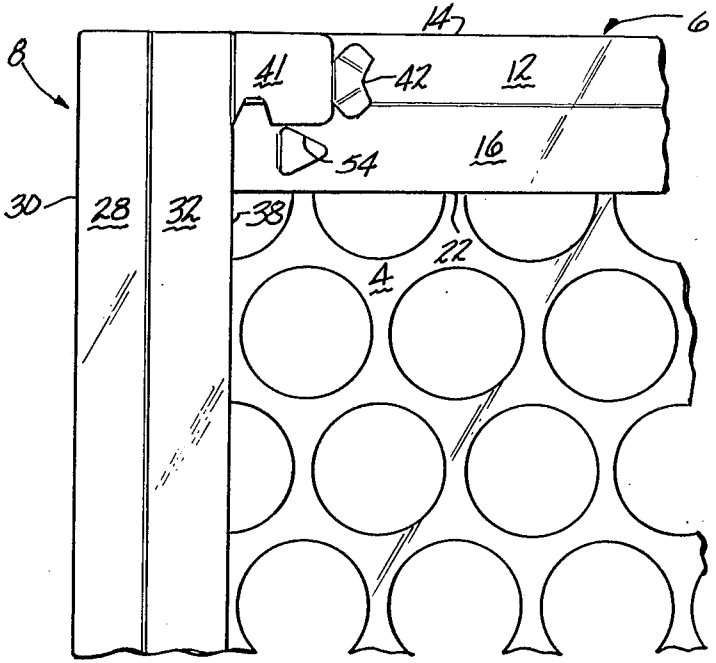
FIG. 6 is a fragmented plan view similar to FIG. 5 but showing the frame in its collapsed shipping and storage configuration.
Figure 7:
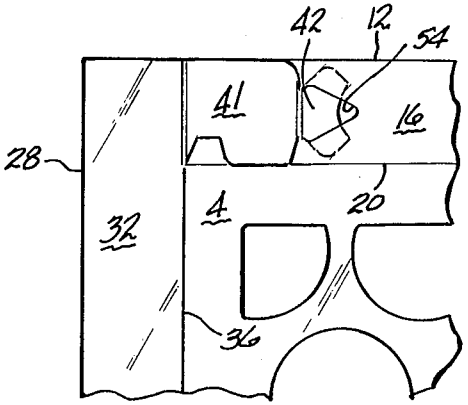
FIG. 7 is a fragmented plan view similar to FIG. 6 but showing the frame in its expanded form.

FIG. 6 shows the frame in its flattened shipping and storage condition wherein the glue panels 24 and 40 are glued to the back wall panel 4 and the framing panels 6 and 8 are folded about the fold lines 14, 22 and 30, 38 respectively. In this condition, the extension flap 41 and locking tab 42 overlie the outer side wall panel 12 and front wall panel 16. The locking slot formed by the cut 54 lies adjacent to the extension flap 41. To convert the flattened configuration to the expanded configuration shown in FIG. 7, one presses the fold lines 14, 22 and 30, 38 toward each other to pivot the side wall panels 12, 20 and 28, 36 into positions perpendicular to the back wall panel 4. This brings the front wall panels 16 and 32 away from the back wall panel 4 and moves the locking tab 42 into alignment with the locking slot cut 54. The locking tab 42 is then inserted through the locking slot cut 54 to lock the frame corners in the expanded condition, as shown in FIG. 7.

Figure 8:
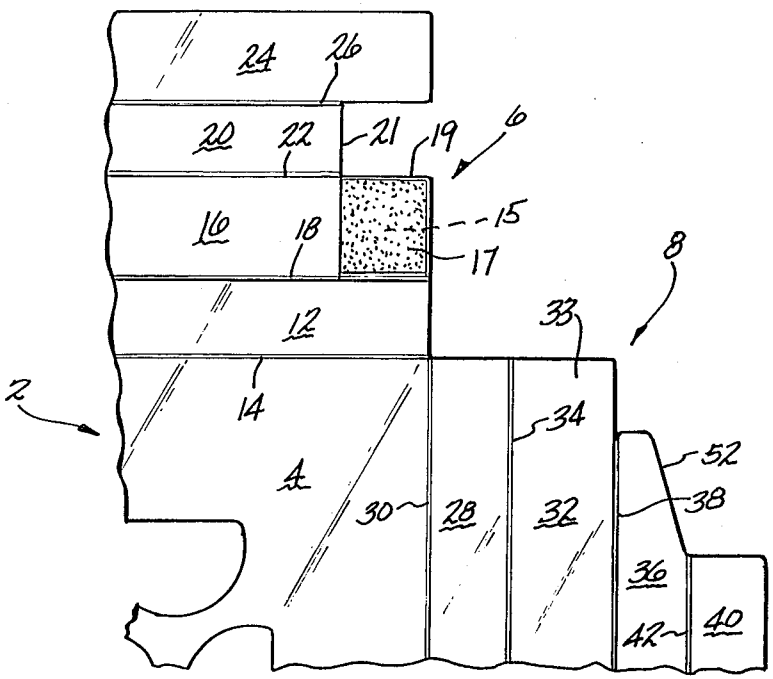
FIG. 8 is a fragmented plan view similar to FIG. 5 but showing a third embodiment of a frame blank formed in accordance with this invention.

Referring now to FIG. 8, a third embodiment of a frame formed in accordance with this invention is shown. The frame blank 2 includes a back wall panel 4 and framing panels 6 and 8. The framing panel 6 includes an outer side wall panel 12 connected to the back wall panel 4 by a fold line 14, a front wall panel 16 connected to the outer side wall panel 12 by a fold line 18, an inner side wall panel 20 connected to the front wall panel 16 by a fold line 22, and a glue panel 24 connected to the inner side wall panel 20 by a fold line 26. The end portion 15 of the front wall panel 16 is coated with an adhesive, which adhesive is covered by a peelable sheet 17. The edge 21 of the inner side wall panel 20 is recessed to form a longitudinal edge 19 on the front wall panel 16 whose length is equal to the width of the front wall panel 16. The framing panel 8 includes an outer side wall panel 28 connected to the back wall panel 4 along a fold line 30, a front wall panel 32 connected to the outer side wall panel 28 along a fold line 34, an inner side wall panel 36 connected to the front wall panel 32 along a fold line 38, and a glue panel 40 connected to the inner side wall panel 36 along a fold line 42. The edge of the inner side wall panel 36 is tapered at 52. The end portion 33 of the front wall panel 32 forms a locking tab.

Figure 9:
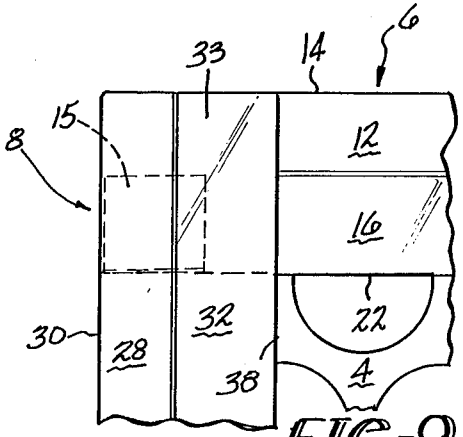
FIG. 9 is a fragmented plan view similar to FIG. 8 but showing the frame in its collapsed shipping and storage configuration.

To form the flattened configuration of the frame shown in FIG. 9, the framing panel 6 is folded about the fold lines 14 and 22 and the glue panel 24 is glued to the back wall panel 4. The framing panel 8 is then folded about the fold lines 30 and 38 to overlie the folded framing panel 6 and the glue panel 40 is glued to the back wall panel 4. In this configuration, the locking tab 33 overlies the outer side wall panel 12 and the adhesive coated end portion 15 of the front wall panel 16 underlies the folded framing panel 8.

Figure 10:
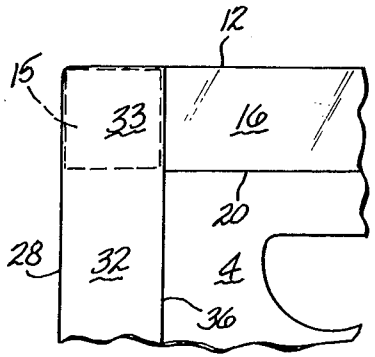
FIG. 10 is a fragmented plan view similar to FIG. 9 but showing the frame in its expanded configuration.

To convert the flattened configuration of the frame to the expanded configuration shown in FIG. 10, the fold lines 14, 22 and 30, 38 are manually pressed together to cause the side wall panels 12, 20 and 28, 36 to pivot to positions perpendicular to the back wall panel while moving the front wall panels 16 and 32 away from the back wall panel 4. The locking tab 33 is thus brought into overlapping relationship with the adhesive coated end portion 15 of the front wall panel 16. The protective sheet 17 is then peeled away and the locking tab 33 is pressed against the exposed adhesive coating 15. The corners of the frame are thus secured in the expanded configuration.

It will be readily appreciated that the frame of this invention can be used in a number of different applications, only one of which is as a holder for furnace filters. The frame is readily machine formed to its flattened configuration and can be easily manually converted to its expanded configuration. The corner locks provide the frame with the necessary stability to resist accidental collapse during handling in the expanded configuration.

Since many changes and variations of the disclosed embodiments of the invention may be made without departing from the inventive concept, it is not intended to limit the invention otherwise than as required by the appended claims.

What is claimed is:

1. A frame formed from a one-piece paperboard blank, said frame comprising:

(a) a back wall panel;

(b) first and second opposed pairs of framing panels foldably connected to edges of said back wall panel;

(c) each framing panel in said first and second pairs thereof including an outer side wall panel foldably connected to said back wall panel, a front wall panel foldably connected to said outer side wall panel, an inner side wall panel foldably connected to said front wall panel, and a glue panel foldably connected to said inner side wall panel, said glue panel being adhered to said back wall panel, each of said framing panels being foldable between a collapsed condition wherein said outer side wall panels and said front wall panels are substantially coplanar and overlie said back wall panel, to an expanded condition wherein said outer and inner side wall panels are substantially perpendicular to said back wall panel and said front wall panels are spaced apart from and substantially parallel to said back wall panel (d) a locking tab formed at end portions of selected ones of said framing panels whereby there is one locking tab formed at each corner of said frame, each of said locking tabs being adapted to overlap an end portion of the top wall panel on the adjacent framing panel when said framing panels are in their expanded condition; and (e) securement means for securing said locking tabs in overlapping relationship to said top wall panels of said adjacent framing panels whereby said frame is locked in said expanded condition.

2. The frame of claim 1 wherein said locking tabs project from edges of the top wall panels of said selected ones of said framing panels and are insertable into locking slots formed in said end portions of said top wall panels on said adjacent framing panels, said locking tabs including ears for interlocking engagement with said locking slots.

3. The frame of claim 2 wherein said locking tabs are positioned on end portions of extension flaps projecting from edges of said top wall panels of said selected ones of said framing panels.

4. The frame of claim 1 wherein said securement means comprises a layer of adhesive applied to said end portions of said top wall panels on said adjacent framing panels, said adhesive being covered by a peelable sheet when said frame is in said collapsed condition.

* * * * *